US006941713B2

(12) United States Patent
Williams

(10) Patent No.: US 6,941,713 B2
(45) Date of Patent: Sep. 13, 2005

(54) MULTI-UNIT TERMINATION ACCESSORY FLASHING

(76) Inventor: Mark F. Williams, 945 Tennis Ave., Maple Glen, PA (US) 19002

( * ) Notice: Subject to any disclaimer, the term of this patent is extended or adjusted under 35 U.S.C. 154(b) by 133 days.

(21) Appl. No.: 10/670,318

(22) Filed: Sep. 26, 2003

(65) Prior Publication Data

US 2005/0066598 A1 Mar. 31, 2005

(51) Int. Cl.[7] ..... E04B 1/70

(52) U.S. Cl. ..... 52/302.6; 52/100; 52/105; 52/219; 52/62

(58) Field of Search ..... 52/98, 100, 105, 52/200, 219, 302.6, 97, 58, 62, 60

(56) References Cited

U.S. PATENT DOCUMENTS 3,838,544 A * 10/1974 Hindall ..... 52/60
4,555,882 A * 12/1985 Moffitt et al. ..... 52/209
5,077,943 A * 1/1992 McGady ..... 52/58
6,401,401 B1 * 6/2002 Williams ..... 52/58

* cited by examiner

*Primary Examiner*—Naoko Slack
(74) *Attorney, Agent, or Firm*—C. J. Husar, Esq.

(57) ABSTRACT

A multi-unit termination accessory for flashing certain through-wall openings in a building. The multi-unit termination accessory unit is thermo-formed in multiples of four with clearly delineated cutting lines for separating the multi-unit flashing member into four identical termination accessory units for use in corners of frame construction rough openings. This multi-unit forming permits multiple units to be formed in a single molding, thus reducing the time and cost per unit. Additionally, the individual termination accessory units are provided with a feature that permits their use with either full depth or partial depth windows thus increasing their versatility and acceptance by the construction industry.

13 Claims, 3 Drawing Sheets

MULTI-UNIT TERMINATION ACCESSORY FLASHING

CROSS-REFERENCE TO RELATED APPLICATIONS

This application is closely related to Ser. No. 09/692,226, filed on Oct. 26, 2000, entitled, Multi-Component Flashing Systems, now U.S. Pat. No. 6,401,401 and Ser. No. 09/777,844, filed on Feb. 7, 2001, entitled, Pre-Folded Flashing Systems and Method, now U.S. Pat. No. 6,401,402, both by the same inventor as the subject application and also another earlier patent entitled Multi-Component Elastomeric Materials For A Building Flashing System issued to Williams et al, as U.S. Pat. No. 5,899,026 on May 4, 1999 and pending application Ser. No. 10/200,259 filed on Jul. 23, 2002 entitled, Integrated System For Controlling Water Intrusion and Air Movement Through Exterior Wall Construction by Mark F. Williams.

BACKGROUND OF THE INVENTION

Although this application is closely related to each of the above-noted applications, it is directly and intimately related to the disclosure of Ser. No. 09/692,226, now U.S. Pat. No. 6,401,401. In this patent to Williams, '401, in FIGS. 7 and 8, there is clearly shown the novel preformed termination accessory that can be used in any of the four corners of a rough opening in frame construction. However, its most likely use will be in both lower corners of the rough opening in frame construction to seal and prevent the intrusion of air, moisture and water at these hard to protect corners. The dimensions of this unique termination accessory are such that by merely rotating the unit ninety degrees, it can be used in either a lower or upper, left or right-hand corner of a construction opening, i.e. any of the four corners of a rough opening. The construction opening can be a rough opening for a window, door, louver, or other wall penetration.

As indicated in the earlier Williams, '401 patent, the termination accessories were manufactured in a single unit molding process, i.e. the mold produced a single unit In the period since the issuance of the Williams, '401 patent it has been found that the costs involved in the production of single units renders the cost prohibitive and new ways of mass producing the termination accessory has been a long sought after goal. In the most recent past, a uniquely designed multiple unit mold that will accommodate a plurality of termination accessory units in a single molding procedure has been developed. It has been found that production of the termination accessory units in batches of four per molding greatly reduces the total costs involved in the production of the termination accessory units to the point where it becomes a real possibility to cost effectively produce these accessory units.

The single molding, by a thermo-forming process, of multiple units results in four interconnected, identical termination accessory units that can be shipped from the point of origin to the end user where the multiple termination accessory units can readily be cut and separated into four individual, identical units ready for use at the construction site.

SUMMARY OF THE INVENTION

The subject invention provides a thermo-molded product that allows multiple, identical termination accessory units to be molded in a single molding procedure, thus significantly reducing the amount of time and cost per unit of the completed termination accessories to the point where their manufacture becomes cost effective and economically feasible. In addition to the multi-unit manufacturing to reduce the overall cost per unit, several new features have been addressed to make the units more useful than before. More specifically, this new multi-unit includes a feature that allows the termination accessory unit to be used with a full depth type of window as well as the partial depth type of windows, thus increasing its overall usefulness in the construction industry. Another feature that has been incorporated into the new termination accessory units is the fact that after cutting into single termination accessory units, it can be conveniently folded into a configuration that allows for product compression prior to and during shipping and subsequently returned to its operative configuration at the job site for installation in a rough window opening.

Yet another feature that has been incorporated into the new termination accessory unit is the fact that after cutting the multi-unit molded component into single termination accessory units, the remaining spaced ridges (which defined the cut-line) serve as a secondary barrier to help control the migration of water.

OBJECTS OF THE INVENTION

An object of the invention is to provide a multi-unit molded termination accessory that are readily separated into individual units at the construction site.

Another object of the invention is to provide a multi-unit molded termination accessory that includes a pair of spaced ridges to form a cut-line therebetween.

A further object of the invention is to provide a multi-unit molded termination accessory wherein the spaced ridges serve to provide a secondary barrier to help control the migration of water.

Yet another object is to provide a multi-unit molded termination accessory made of moldable elastomeric material such as high density polyethylene (HDPE) material.

A still further object of the invention is to provide a termination accessory unit that can readily be used in full, as well as, partial depth types of windows.

A further object of the invention is to provide a single termination accessory unit that can be folded into a flat configuration and allow for easy shipment with a window, door or louver unit.

These and other objects of the invention will become more apparent hereinafter. The instant invention will now be described with reference to the accompanying drawings wherein like reference characters designate the corresponding parts throughout the several views.

DETAILED DESCRIPTION OF THE DRAWINGS

Figure 1:
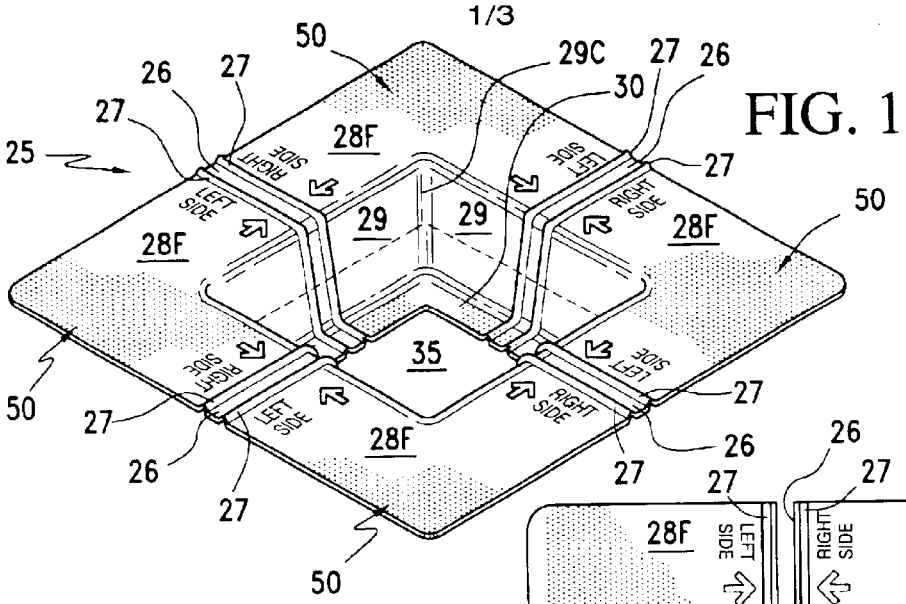
FIG. 1 is a perspective view illustrating the multi-unit termination accessory immediately after removal from the mold.

Referring now to FIG. 1, there is shown a perspective view of the novel multi-unit termination accessory 25 that includes four individual and identical termination accessory units 50 after separation by cutting along cutting lines 26 which are located between a pair of spaced ridges 27 that serve as a guide for the cutting operation. As illustrated multi-unit termination accessory 25 includes an enlarged frontal area that is divided into four L-shaped regions 28F that are interconnected by a pair of spaced ridges 27 and cutting line 26 therebetween, this aspect is more clearly shown in FIG. 5. Each L-shaped frontal area 28F includes a pair of integral downwardly extending portions 29 that are disposed at approximately ninety degrees relative to frontal area 28F and to each other with corner portion 29C interconnecting downwardly extending portions 29. Each downwardly extending portion 29 is followed by a pair of interconnected relatively shorter lip portions 30 disposed at approximately ninety degrees relative to each other and also to downwardly extending portions 29.

Figure 2:
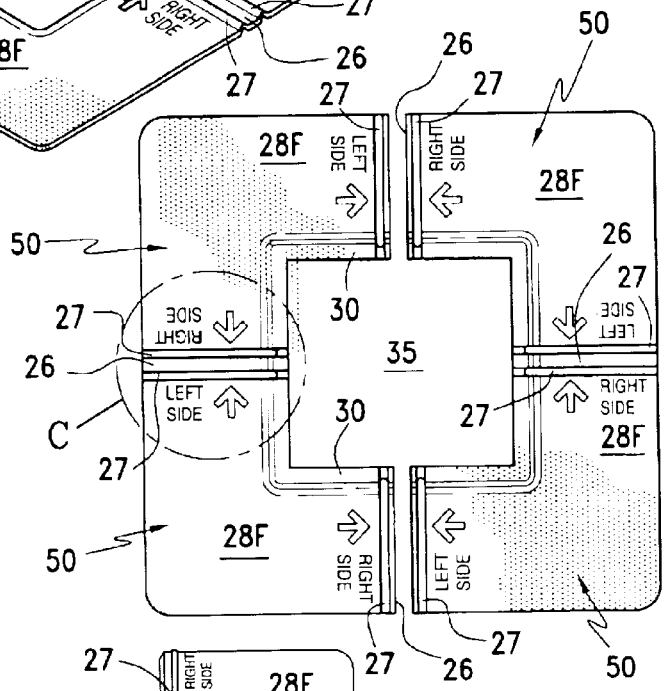
FIG. 2 is a plan view of the multi-unit termination accessory separated into two individual units of two units each.

Turning now to FIG. 2, there is shown a plan view of the multi-unit termination accessory unit 25 after it has been divided into two portions of two units 50 in each portion. This configuration of two portions with two units 50 in each portion may be more easily handled and packaged for shipment than the multi-unit termination accessory 25 shown in FIG. 1.

Figure 3:
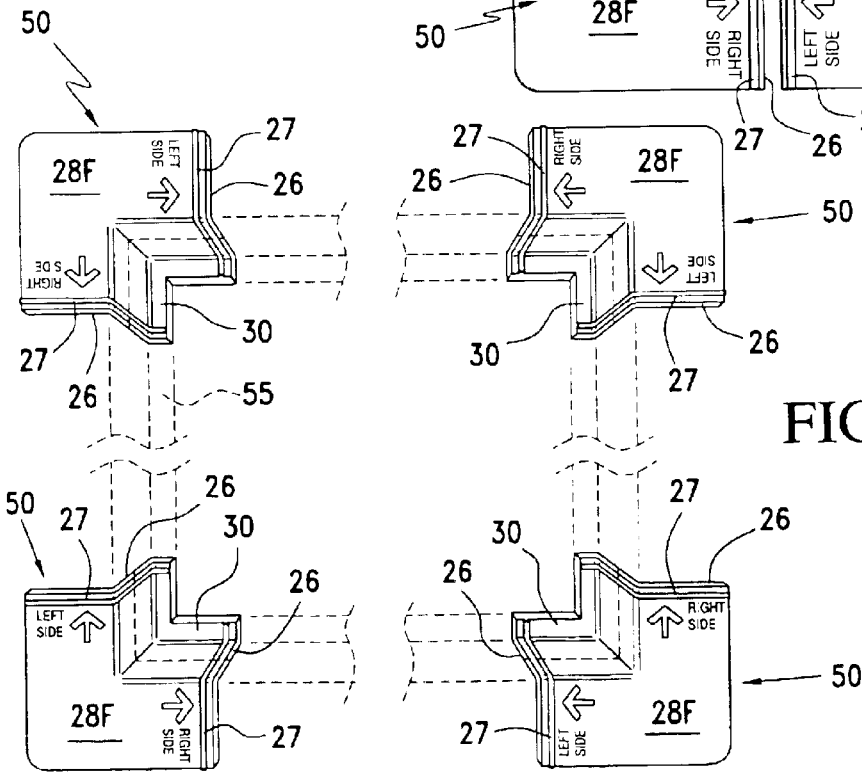
FIG. 3 is an illustration of the manner of use in a rough opening, with a termination accessory unit installed in each of the four corners thereof prior to installation of the connector flashing material that spans between the termination accessory units. After the connector flashing material is installed, the window, door, louver or other through-wall component is installed.

FIG. 3 is an illustration showing four individual termination accessory units 50 that have been cut along their cutting lines 26 and installed in the four corners of a rough opening 55. As shown, the two lower termination accessory units 50 are oriented and placed in their respective positions by following the arrows and terminology embossed on the frontal surface 28F of the units 50 while the two upper units 50 have to be inverted without regard to the arrows and terminology on the units 50. Although rough opening 55 is shown with four termination accessory units 50, i.e. one unit 50 in each of the respective corners, more than likely, some construction jobs will be provided with only two such units 50, i.e. one in each of the two lower corners of rough opening 55.

Figure 4:
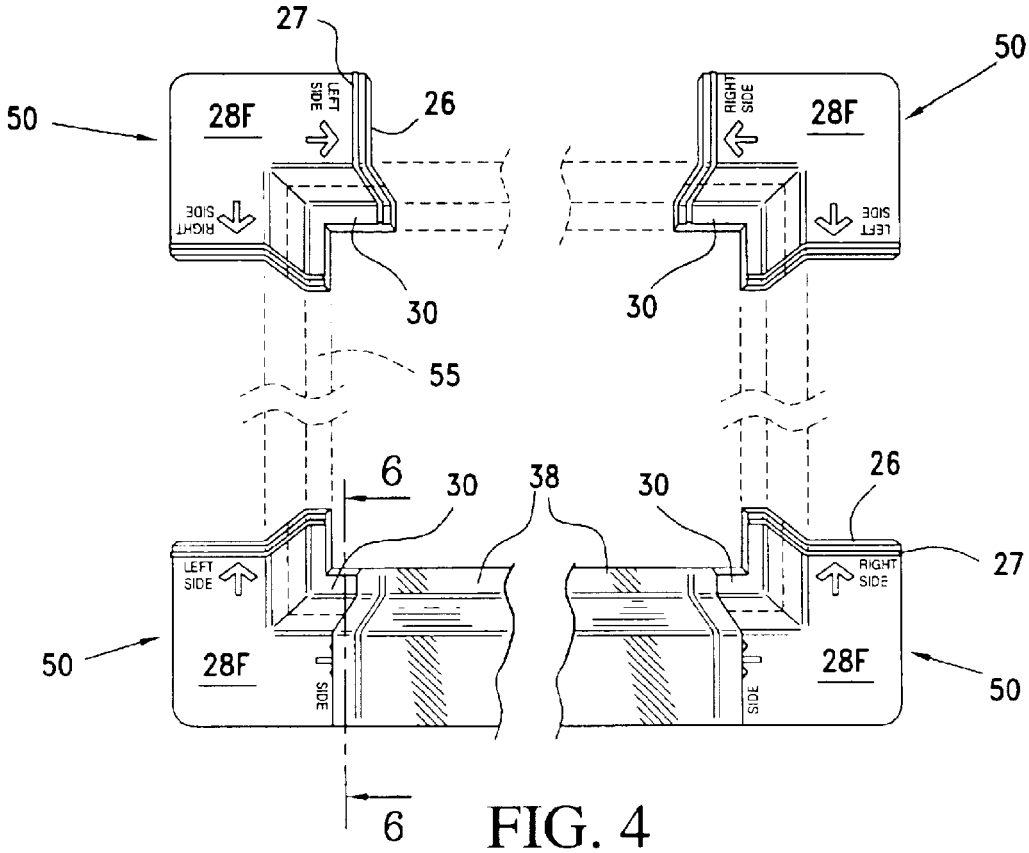
FIG. 4 is an illustration similar to the showing of FIG. 3, however, in this view, the two lower termination accessory units are joined by the connector flashing material, which in this case, is a piece of self-adhering flashing material.

FIG. 4 is a view similar to the showing of FIG. 3, however, in this view the connector material, a piece of self-adhesive flashing material 38, has been placed over the sill edge portions of termination accessory units 50 to seal the gap therebetween. Although the connector material 38 is only shown joining the two lower termination accessory units 50, three additional pieces of flashing connector material should be installed when the remaining termination accessory units 50 are installed a the top of the opening to provide complete sealing of the rough opening 55 thereby.

Figure 5:
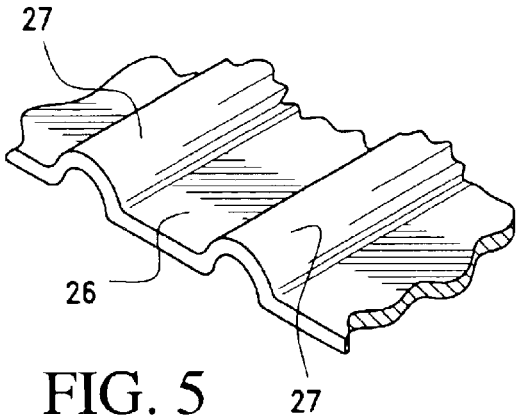
FIG. 5 is an enlarged illustration of the subject matter encircled in the circle designated "C" in FIG. 2.

FIG. 5 is an enlarged view of the area encircled by the circle designated "C", in FIG. 2. This view clearly illustrates the two spaced ridges 27 with a flat cutting line portion 26 therebetween. This cutting line 26 is the line followed when cutting the multi-unit termination accessory 25 into individual units 50.

Figure 6:
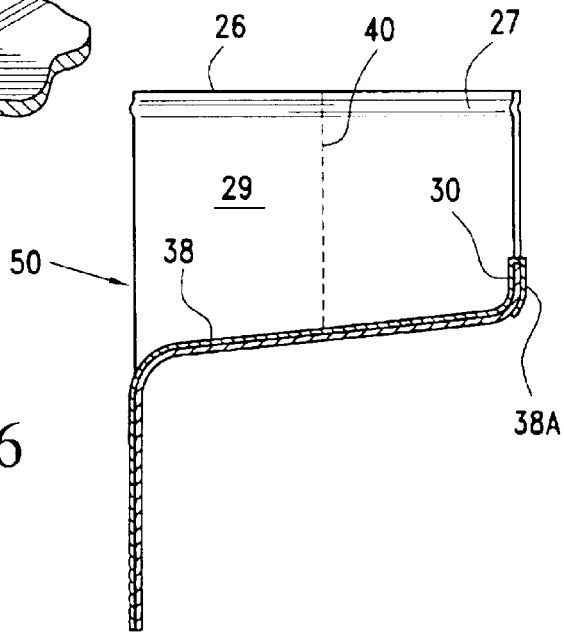
FIG. 6 is a sectional view taken along the plane 6—6 of FIG. 4 showing the doubling over of the self-adhering flashing, which is used as the connector material in this example.

FIG. 6 is a sectional view taken along the plane 6—6 of FIG. 4, illustrating the manner in which self-adhesive flashing material 38 is installed to bridge between the two lower termination accessory units 50 and provide an effective seal therebetween. Also, it can readily be seen that the opposite ends of connecting material 38 overlaps lip-portions 30 of the respective termination accessory units 50 with lip-portions 30 serving as a guide in forming the interconnecting lip portion 38A of connecting material 38. Additionally, it can also be seen in this view that there is a slight downward slope to the termination accessory units 50 and also connecting material 38 to encourage drainage of any water away from the rough opening 55.

Figure 7:
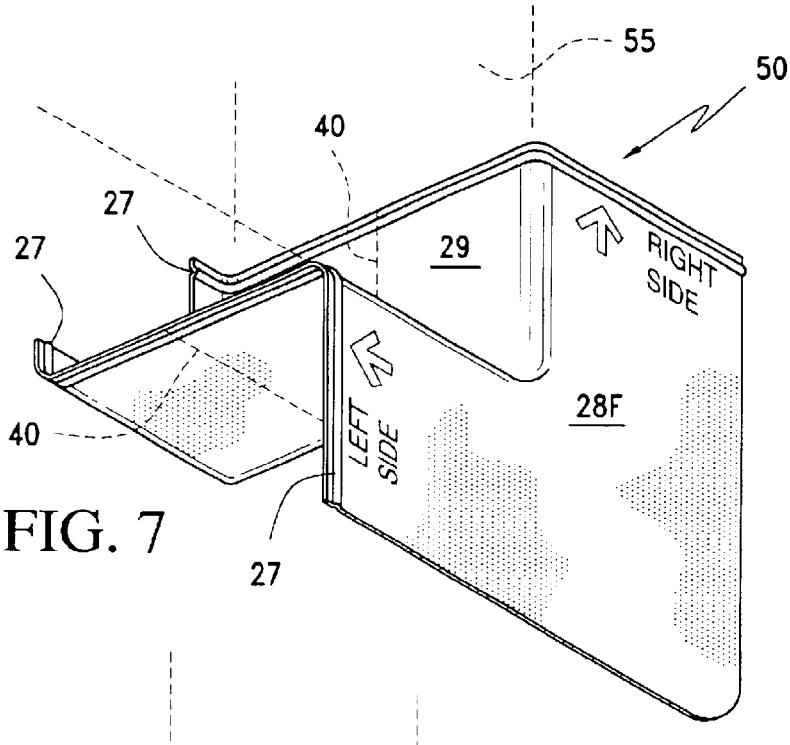
FIG. 7 is a perspective view of a full depth termination accessory unit placed in the lower right-hand corner of a rough opening shown in phantom.

FIG. 7 is a perspective view illustrating a single termination unit 50 installed in a lower corner of a full depth rough opening 55. Additionally, a second cutting line 40 is shown on downwardly extending portion 29 in an approximately mid-position thereof. As indicated above, this figure illustrates termination accessory unit 50 used on a full depth rough opening 55.

Figure 8:
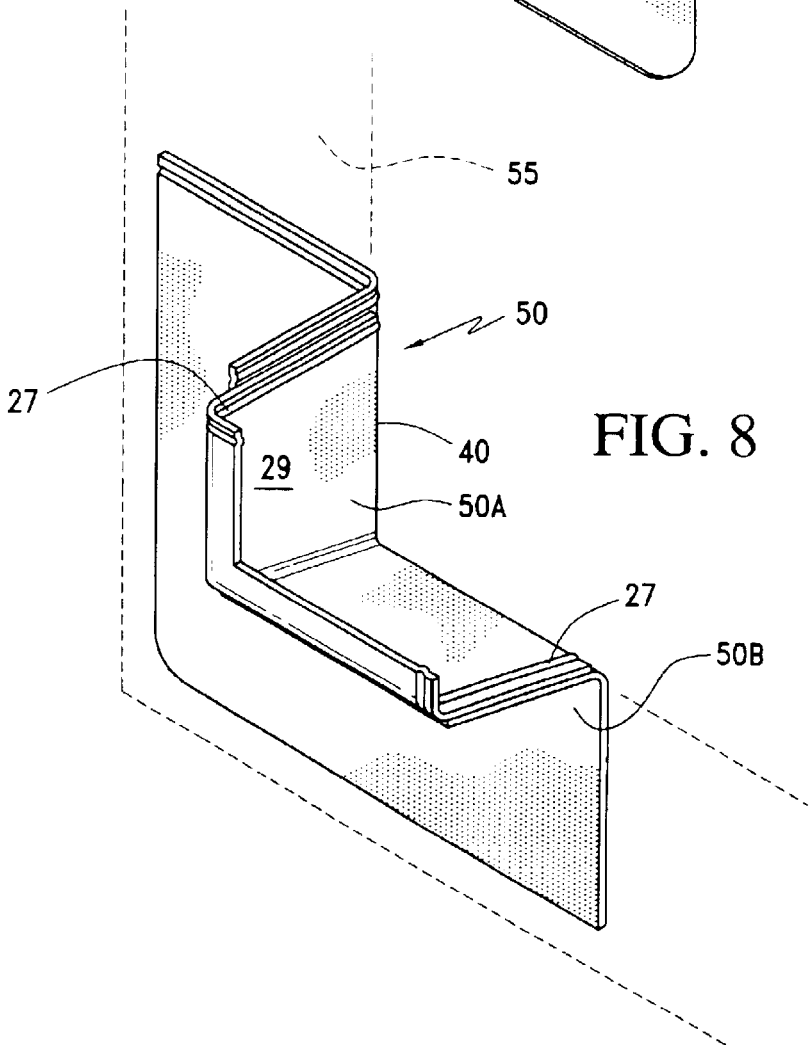
FIG. 8 is a view similar to FIG. 7, however, it is shown from the rear looking forward out the rough opening and is an illustration of a partial-depth termination accessory unit.

FIG. 8 is a perspective view similar to that of FIG. 7, however, in this view the rough opening is a partial depth rough opening meaning that the depth of the window construction is less than the standard full depth window. In this embodiment, termination accessory 50 of FIG. 7 has been cut along second cutting line 40 to reduce the depth of the accessory unit and accommodate a partial depth window. After cutting along line 40, the inner half portion 50A has been superimposed over the outer half portion 50B with a sealant mastic applied between the inner and outer half portions 50A and 50B and followed by a strip of self-adhesive flashing material 38 thereover. It can be seen that by applying a mastic sealant between the upper and lower portions of the termination accessory unit 50, mastic sealant will fill the area beneath ridges 27 and serve as an additional barrier to the intrusion of air, water and moisture.

It should be noted that although high density polyethylene (HDPE) has been designated as the preferred material for forming the termination accessory units, there are many other suitable materials that can be used just as well. For example, there are many suitable sheet materials that can be thermo-formed as well as elastomeric materials that can be molded in multiple units and provide the same benefits as outlined above. Similarly, there are many commercially available flashing materials, such as Valeron® metallic flashing materials that can be sealing joined to the termination accessory units through the use of various mastics or sealants.

While the invention has been described in its preferred embodiment, it is to be understood that the words which have been used are words of description rather than words of limitation and that changes may be made within the purview of the appended claims without departing from the full scope or spirit of the invention. Accordingly, the present invention is to be limited only by the appended claims, and not by the foregoing specification.

I claim:

1. A multi-unit termination accessory for use in limiting intrusion of air, water and moisture into a frame construction rough opening when separated into individual termination accessory units comprising:

a frontal area having a centrally located depression;

said frontal area having a plurality of L-shaped flat surface areas that are interconnected by a plurality of spaced ridges and a first cutting line therebetween whereby cutting along said cutting line and separating said multi-unit termination accessory into a plurality of identical, individual termination accessory units allows use in any one of the four corners of a rough opening when installed therein to provide sealing thereat and limit air, water and intrusion therethrough.

2. A multi-unit termination accessory for use in limiting intrusion of air, water and moisture into a frame construction rough opening as defined in claim 1 wherein said plurality of identical, individual termination accessory units is four in number.

3. A multi-unit termination accessory for use in limiting the intrusion of air, water and moisture as defined in claim 2 wherein each of said four frontal areas has multiple indicators for designating the preferred proper orientation of the individual termination accessory units when installed in the lower corners of a rough window opening.

4. A multi-unit termination accessory for use in limiting intrusion of air, water and moisture as defined in claim 2 wherein two of said four individual termination accessory units are installed in the two lower corners of a rough window opening and an intermediate piece of self-adhesive flashing material spans the gap between said two termination accessories to complete the flashing of the lower sill portion of said rough window opening.

5. A multi-unit termination accessory for use in limiting intrusion of air, water and moisture as defined in claim 2 wherein two of said four individual termination accessory units are installed in the two lower corners of a rough window opening and an intermediate piece of sheet material sealingly joins said accessory units and spans the gap between said two termination accessories to complete the flashing of the lower sill portion of said rough window opening.

6. A multi-unit termination accessory for use in limiting intrusion of air, water and moisture as defined in claim 2 wherein said four individual termination accessory units are installed in the each of the respective lower and upper corners of a rough of a rough window opening and an intermediate piece of self-adhesive flashing material spans the gap between said individual termination accessory units to complete the flashing on all four sides of a rough window opening.

7. A multi-unit termination accessory for use in limiting intrusion of air, water and moisture into a frame construction rough opening as defined in claim 1 wherein said centrally located depression is formed by a plurality of pairs of forwardly projecting wall portions connected to inner edges of said L-shaped portions and terminating in a pair of interconnected lip portions extending perpendicular to said downwardly extending portions leaving a central opening therein.

8. A multi-unit termination accessory for use in limiting the intrusion of air, water and moisture into a frame construction rough opening as defined in claim 7 wherein the number of said plurality of pairs of downwardly extending wall portions is four.

9. A multi-unit termination accessory for use in limiting intrusion of air, water and moisture into a rough construction opening as defined in claim 8 wherein said second cutting line is a continuous horizontal line disposed midway down said downwardly projecting wall portions allowing severing said termination accessory unit into two portions whereby after placing one of said two portions in sealing relation to said other portion and sealant fills the underside of ridges, said termination accessory unit serves to seal and limit the intrusion of air, water and moisture into a partial-depth rough window opening.

10. A multi-unit termination accessory for use in limiting intrusion of air, water and moisture into a frame construction rough opening as defined in claim 1 wherein said individual termination accessory units each include a second cutting line for converting said unit from a full-depth unit to a partial-depth unit thus allowing its use in sealing either a full or partial-depth rough opening in any of its four corners.

11. A multi-unit termination accessory for use in limiting intrusion of air, water and moisture into a frame construction rough opening as defined in claim 1 wherein said plurality of individual accessory units are made of high density polyethylene material.

12. A multi-unit termination accessory for use in limiting intrusion of air, water and moisture into a frame construction rough opening as defined in claim 1 wherein said plurality of individual termination accessory units are made of any suitable sheet plastic material that can be thermo-formed.

13. A multi-unit termination accessory for use in limiting intrusion of air, water and moisture into a frame construction rough opening as defined in claim 1 wherein said plurality of individual termination accessory units are made of elastomeric material that can readily be molded.

* * * * *